US005572766A

United States Patent [19]

Matsuura et al.

[11] Patent Number: 5,572,766

[45] Date of Patent: Nov. 12, 1996

[54] IN-DUCT CLEANING APPARATUS

[75] Inventors: Kenji Matsuura, Moriyama; Katsumi Toritani, Miki, both of Japan

[73] Assignees: Ataka Construction & Engineering Co., Ltd., Osaka; Kobe Machatronics Co., Ltd., Kobe, both of Japan

[21] Appl. No.: 967,500

[22] Filed: Oct. 28, 1992

[30] Foreign Application Priority Data

Jul. 27, 1992 [JP] Japan ..... 4-220684

[51] Int. Cl.[6] ..... A47L 25/00

[52] U.S. Cl. ..... 15/304; 15/319; 15/340.1; 15/383

[58] Field of Search ..... 15/104.05, 104.09, 15/302, 304, 316.1, 339, 340.1, 383, 387, 393, 395, 398, 400, 406, 319

[56] References Cited

U.S. PATENT DOCUMENTS

| | | | |
|---|---|---|---|
| 1,122,246 | 12/1914 | Beam | 15/104.05 |
| 3,004,278 | 10/1961 | Stanley | 15/104.09 |
| 3,074,098 | 1/1963 | Downing | 15/406 |
| 3,106,491 | 10/1963 | Leibner | 15/406 |
| 3,267,504 | 8/1966 | Cook | 15/406 |
| 3,800,358 | 4/1974 | Ryan | 15/395 |
| 4,795,495 | 1/1989 | Dobson | 15/104.09 |
| 4,995,201 | 2/1991 | von Borcke | 15/395 |
| 5,020,188 | 6/1991 | Walton | 15/304 |

*Primary Examiner*—David Scherbel
*Assistant Examiner*—Terrence R. Till
*Attorney, Agent, or Firm*—Edwin E. Greigg; Ronald E. Greigg

[57] ABSTRACT

An in-duct cleaning apparatus characterized by comprising a traveling truck, an ejection nozzle body for ejecting compressed air, a cleaning brush body, and a remote-control portion; the ejection nozzle body being attached to the front part of the traveling truck and made to rotate, the cleaning brush body being attached to the circumferential part of the ejection nozzle body, and the remote-control portion being able to control remotely the traveling of the traveling truck and the rotation of the ejection nozzle body.

7 Claims, 5 Drawing Sheets

IN-DUCT CLEANING APPARATUS

COPENDING APPLICATION

This application is copending with application Ser. No. 07/967,502 filed Oct. 28, 1992.

FIELD OF THE INVENTION AND PRIOR ART STATEMENT

1. Field of the Invention

This invention relates to an apparatus for cleaning the surface inside a duct while traveling inside the duct.

2. Description of the Prior Art

As an in-duct cleaning apparatus, heretofore, the one to perform in-duct cleaning only by ejecting compressed air or only by using a brush has been provided.

However, an in-duct cleaning apparatus which used only a compressed air ejecting nozzle or only a cleaning brush could not always perform satisfactory cleaning on account of diverse states and kinds of alien substances such as the deposits inside the duct. Further, in said conventional in-duct cleaning apparatus which used a cleaning brush, the brush rotated keeping in touch with the broad area of the surface inside the duct, generated a large contact resistance, overloaded the electric motor which drove the brush, and slowed it down according to the kinds of alien substances adhered to the surface inside the duct. As a result, there occurred the following troubles in the conventional in-duct cleaning apparatus: the cleaning effect given by the cleaning brush was lowered; or the whole of the traveling truck of the apparatus was exerted such a large reaction as a torsion and was inclined or overturned; as a whole, the in-duct cleaning could not suitably be performed.

OBJECT AND SUMMARY OF THE INVENTION

It is an object of this invention to provide an in-duct cleaning apparatus which:

- is equipped with both of an ejection nozzle body for ejecting compressed air and a cleaning brush body;
- makes said both bodies operate at the same time and yield a cooperative cleaning effect;
- makes said cleaning brush body, which is in use and making contact with the surface inside the duct, exert no large reaction on the electric motor for driving said cleaning brush body or on the whole of the traveling truck; and
- makes the in-duct cleaning effect brought about by said cleaning brush body elevated.

To attain the above object, the in-duct cleaning apparatus of the present invention is firstly characterized by comprising a traveling truck, an ejection nozzle body for ejecting compressed air, a cleaning brush body, and a remote-control portion; said ejection nozzle body being attached to the front part of said traveling truck and made to rotate, said cleaning brush body being attached to the circumferential part of said ejection nozzle body, and said remote-control portion being able to control remotely the traveling of said traveling truck and the rotation of said ejection nozzle body.

In addition to said first characteristic, the in-duct cleaning apparatus of the present invention is secondly characterized by that the ejection nozzle body is provided with plural number of compressed air ejecting holes each of which is pointed toward the oblique front of the traveling truck and that the cleaning brush body is constructed such that its plural number of bundles of brush pieces are planted radially and at fixed intervals on the circumferential part of said ejection nozzle body.

Said two characteristics of the present invention yield operational effects as follows.

By virtue of said first characteristic, the ejection nozzle body for ejecting compressed air is attached to the front part of the traveling truck and is made to rotate, also the cleaning brush body is attached to the circumferential part of the ejection nozzle body which is rotated, and the cooperative cleaning operation by both of said ejection nozzle body and said cleaning brush body is performed under the remote control of the remote-control portion. Thus, the cooperative cleaning effect based on both of the compressed air producing blowing-off effect and the brush producing cleaning effect can be acquired.

By virtue of said second characteristic, in addition to the operational effect brought about by said first characteristic, the compressed air is ejected from each of the plural number of compressed air ejecting holes of the rotating ejection nozzle body toward the oblique front of the traveling truck and is blown against the surface inside the duct, and also each of "the bundles of brush pieces" planted on the circumferential part of said rotating ejection nozzle body arrives rotatingly upon a certain surface part inside the duct successively in order to clean that part dustingly. Accordingly, the surface inside the duct can be doubly and thoroughly cleaned out by both of the compressed air and the cleaning brush body.

Said cleaning by the cleaning brush body is performed by the bundles of brush pieces planted on only plural number of spots on the circumferential part of the ejection nozzle body, so that the contact area between said cleaning brush body and the surface inside the duct becomes small. As a result; such a trouble that the electric motor for driving the cleaning brush becomes, as in the prior art, overloaded and slowed down; or that the whole of the small traveling truck becomes twisted, inclined, or overturned; can be avoided. It is a matter of course that the rotation of the bundles of brush pieces becomes free from being slowed down and said bundles of brush pieces can dustingly clean the surface inside the duct effectively with appropriate force.

DESCRIPTION OF THE PREFERRED EMBODIMENT

The preferred embodiments of the in-duct cleaning apparatus of the present invention will be described in accordance with FIG. 1 to FIG. 6.

Figure 1:
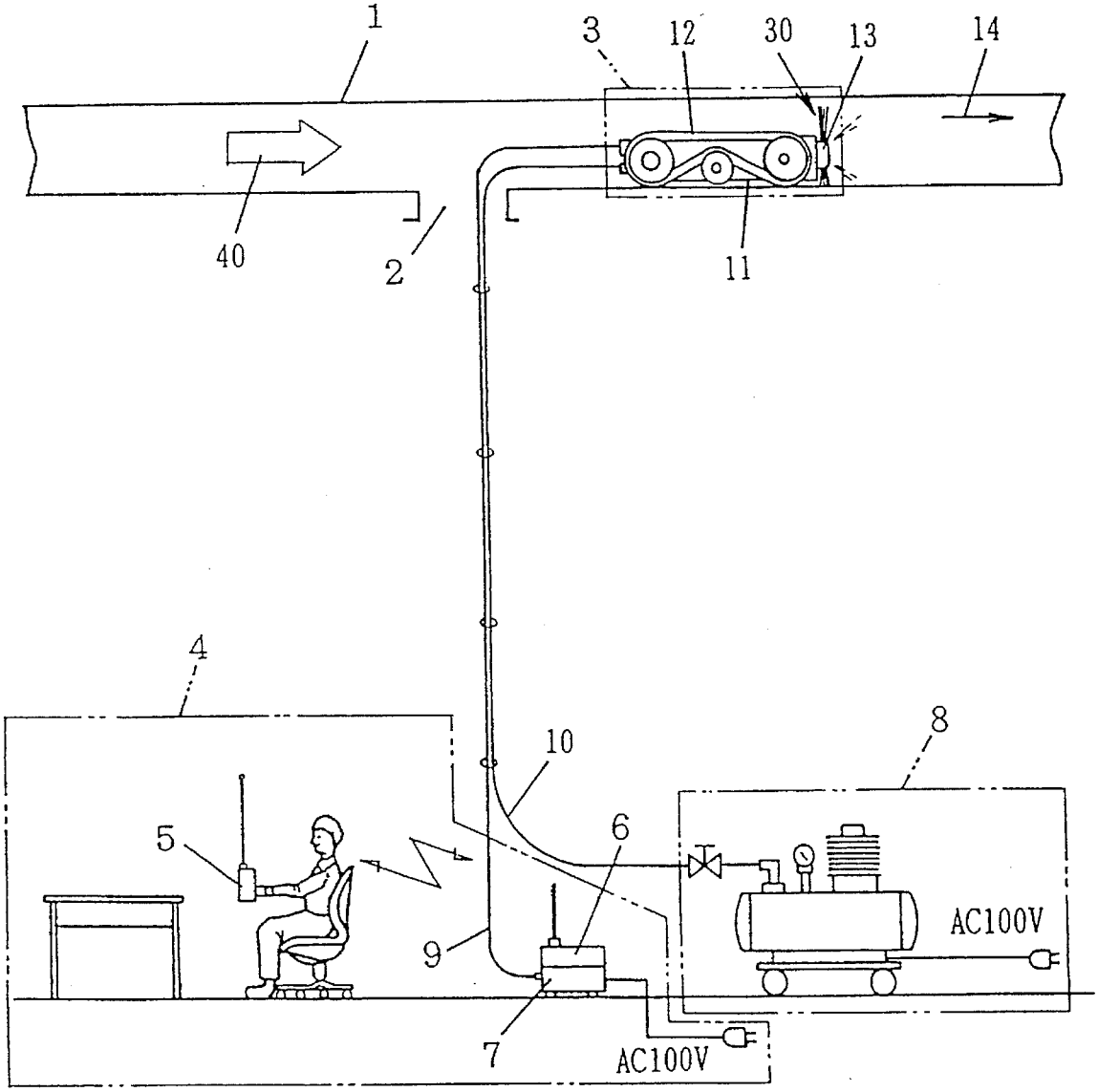
FIG. 1 is an illustrative drawing showing the whole aspect of the preferred embodiments of the present invention.
Figure 3:
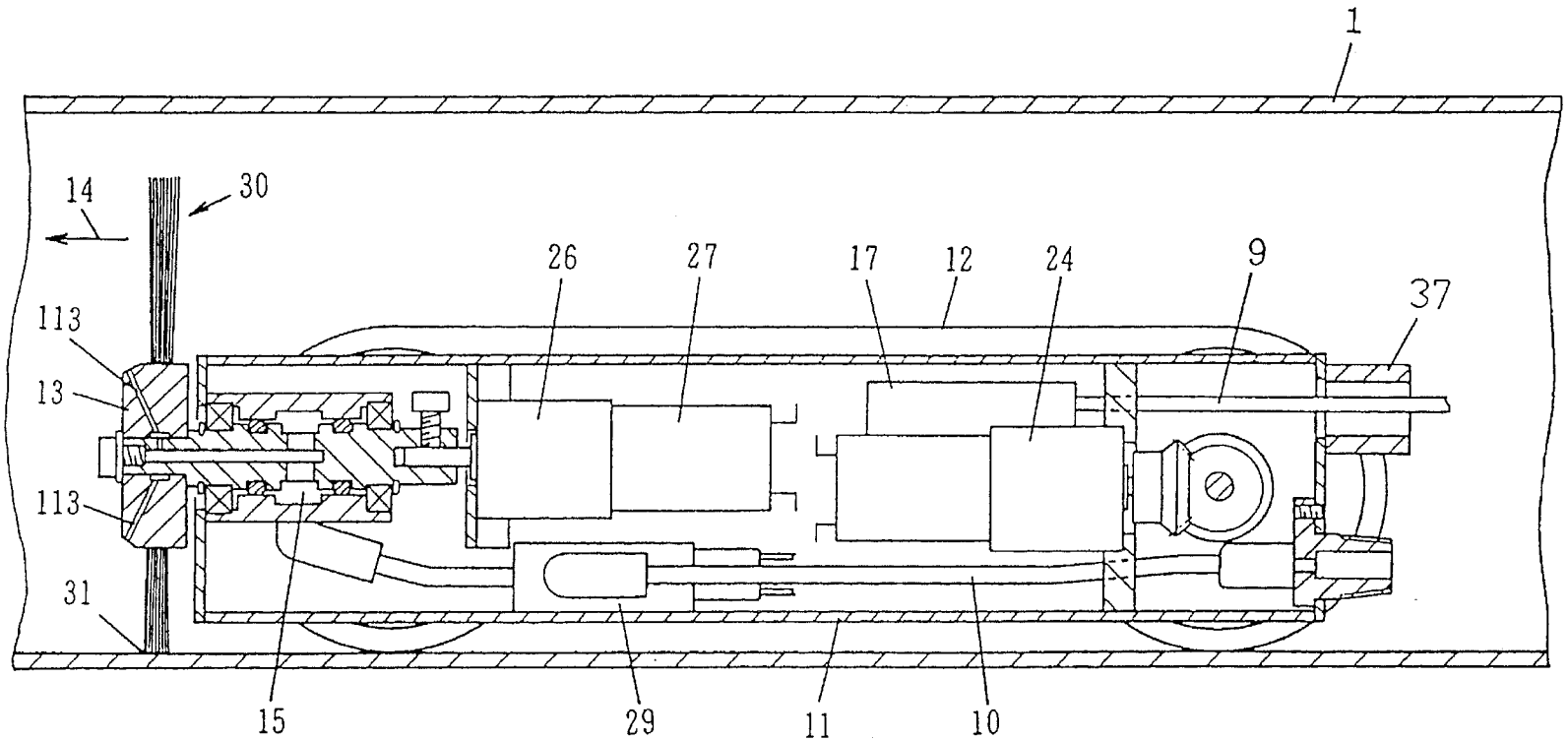
FIG. 3 is a partly cross sectional side view showing the traveling portion in said preferred embodiments.
Figure 4:
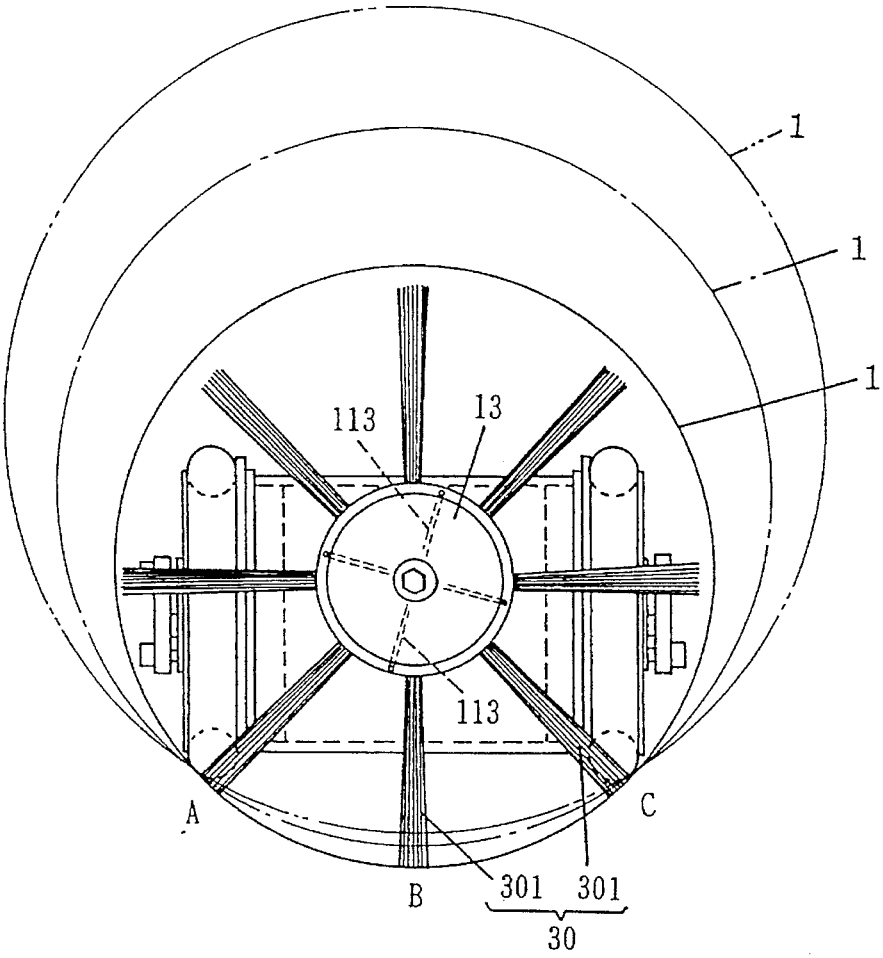
FIG. 4 is a front view showing the traveling portion in said preferred embodiments.
Figure 5:
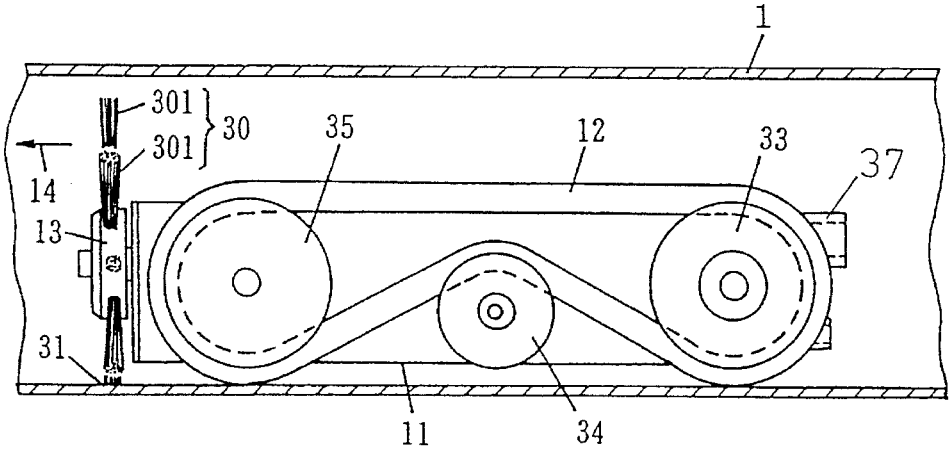
FIG. 5 is an appearance side view showing the traveling portion in said preferred embodiments.
Figure 6:
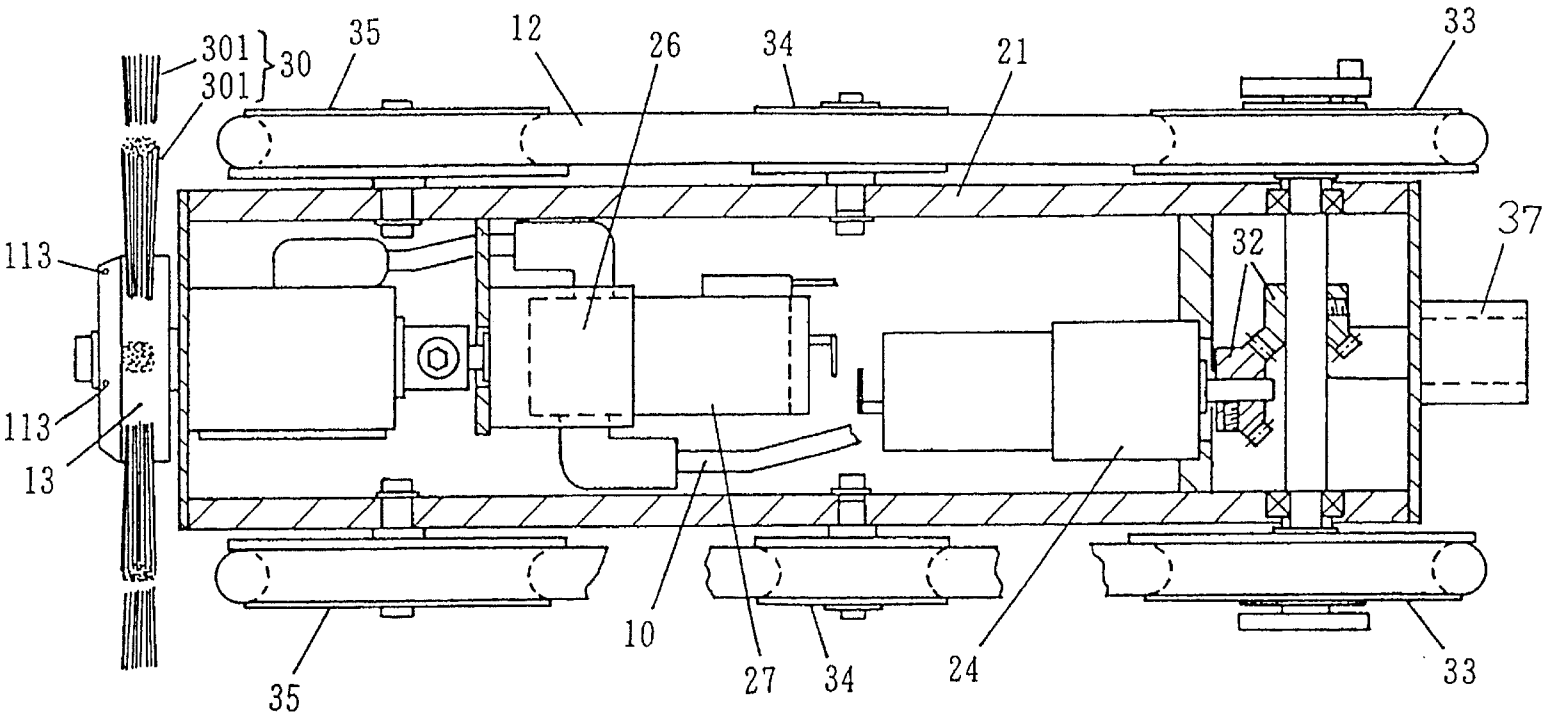
FIG. 6 is a plan view showing the traveling portion in said preferred embodiments.

In FIG. 1; 1 is a duct; 2 is an entry of equipment and materials to the duct 1; 3 is a traveling portion carried in through the entry 2; 4 is a remote-control portion to control remotely the traveling portion 3 by using a remote-control switch 5; 6 is a transmitter; 7 is a power supply unit supplied with AC-100V, having a battery built-in to enable itself to work about 5 hours even when said AC-100V supply is interrupted; 8 is a compressor for generating compressed air; 9 is an antenna line for transmitting the signal sent out from the remote-control portion 4 to the traveling portion 3; 10 is an air tube for transmitting the compressed air generated by the compressor 8 to the traveling portion 3; 11 is a traveling truck equipped with power transmitting round belts 12 (refer to FIG. 3, FIG. 5, and FIG. 6); 13 is an ejection nozzle body or cleaning head for ejecting compressed air (refer to FIG. 3 to FIG. 6); 30 is a cleaning brush body attached to the circumferential part of said ejection nozzle body 13 (refer to FIG. 3 to FIG. 6) ; and 14 is a direction in which the traveling truck 11 progresses inside the duct 1 (refer to FIG. 3 and FIG. 5).

Figure 2:
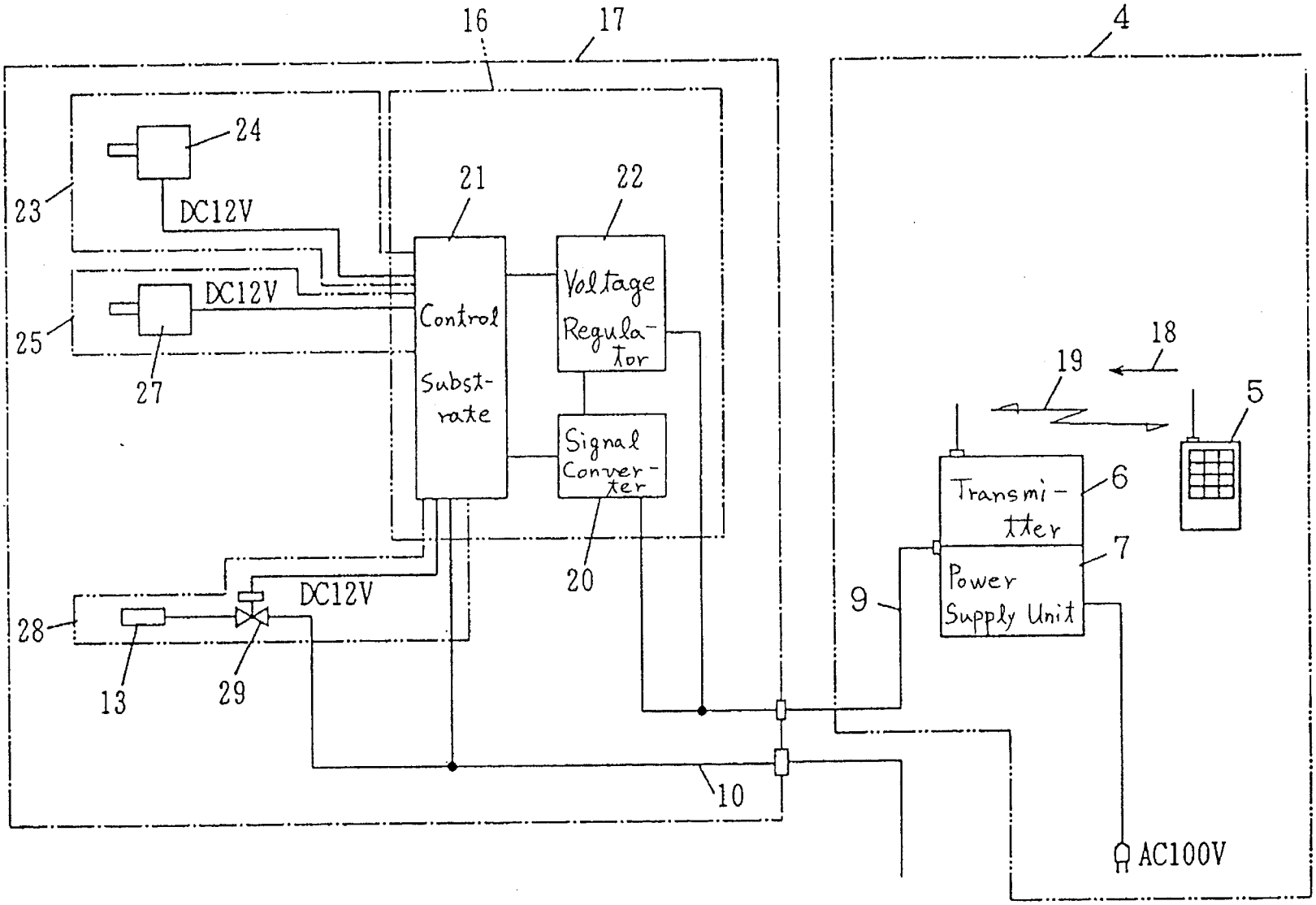
FIG. 2 is a block diagram showing the outline of the traveling portion controller on board a traveling portion and the remote-control portion remotely connected to said traveling portion controller in said preferred embodiments.

Hereinafter, explanation will be given referring to FIG. 2 to FIG. 6. 15 is a rotary air joint to receive the compressed air transmitted through said air tube 10 (refer to FIG. 3); and 16 is the central part of a traveling portion controller 17 (refer to FIG. 2). The remote-control switch 5, the transmitter 6, the power supply unit 7 and the antenna line 9 in the remote-control portion 4 connected remotely to the traveling portion controller 17, have already been described. As shown in FIG. 2, the transmitter 6 receives later-described operating signals 18 which an operator sends out by using the remote-control switch 5 via a radio wave line 19, and transmits said operating signals 18 to a control substrate 21 via the antenna line 9 and a traveling portion electric socket 37 and also via a signal converter 20 in the traveling portion controller 17 in order to make said control substrate 21 execute the control of each of the later-described several systems. 22 is a voltage regulator for regulating the voltage to "the electric equipment of each of the later-described several systems", i.e., "each load hanging on the control substrate 21". 23 is a traveling's system comprising a DC-12V electric motor 24 to drive "driving wheels 33" via miter gears 32 (refer to FIG. 6) and also to drive "driven wheels 35" via guide rollers 34 for propelling the traveling truck 11. 25 is a main shaft rotating system comprising a DC-12V electric motor 27 (set up on the traveling truck 11) to drive "a main shaft 26 to drive the ejection nozzle body 13 for ejecting the compressed air" (refer to FIG. 3 and FIG. 6). 28 is an ejection nozzle system comprising the ejection nozzle body 13 which ejects the compressed air transmitted through the air tube 10 via a DC-12V electromagnetic valve 29. Further it should be added that; when the aforementioned remote-control switch 5 is used, several operating signals 18 to effect the following can be sent out: putting on or off the control substrate 21; making the traveling truck 11 turn left or right, or go ahead or backward, or stop; making the main shaft 26 start or stop rotation; and making the ejection nozzle body 13 start or stop the ejction of the compressed air by opening or closing the electromagnetic valve 29.

As aforesaid, when the main shaft 26 is rotated by the main shaft rotating system 25, the ejection nozzle body 13 fixed to the nose of said main shaft 26 (the front part of the traveling truck 11) is also rotated, and from this rotating ejection nozzle body 13, the compressed air is ejected. The compressed air comes from the compressor 8, and is introduced into the ejection nozzle body 13 via the air tube 10 and the electromagnetic valve 29 and also via the rotary air joint 15. Further, with said rotation of the ejection nozzle body 13, the cleaning brush body 30 (refer to FIG. 3 to FIG. 6) fixed to the circumferential part of the ejection nozzle body 13 also rotates, and removes the alien substances adhered to the contact part 31 (refer to FIG. 3 and FIG. 5) of the surface inside the duct 1. The alien substances thus removed by both of the compressed air and the cleaning brush body 30 are then exhausted out of the duct 1 through its alien substance exhaust port (which is not illustrated here) by force of a draft 40 in the duct 1 (refer to FIG. 1). As above-mentioned, the cleaning operation by the compressed air ejected from the rotating ejection nozzle body 13 and that by the cleaning brush body 30 fixed to the ejection nozzle body 13 and made to rotate together with the ejection nozzle body 13, i.e., the both cleaning operations are performed at the same time. Namely, two cleaning operations each of which is effective against various deposits and adhesions of alien substances overlap each other and can yield a cooperative effect.

As the ejection nozzle body 13, the one provided with the plural number (e.g., four) of compressed air ejecting holes 113 each of which can make an ejection of the compressed air toward the oblique front of the traveling truck 11 can be used (refer to FIG. 3 and FIG. 4). As the cleaning brush body 30, the one constructed such that its plural number of bundles 301 of brush pieces are planted radially and at fixed intervals on the circumferential part of the ejection nozzle body 13 can be used (refer to FIG. 3, FIG. 4, and FIG. 6).

Accordingly, the in-duct cleaning apparatus of this preferred embodiment can make said ejection nozzle body 13 clean the surface inside the duct 1 in oblique front of the traveling truck 11 by using the compressed air ejected from its plural number of compressed air ejecting holes 113, and together with that, the apparatus can make the cleaning brush body 30 clean the same place of the surface inside the duct 1 overlappingly, and thus the apparatus can execute a thoroughgoing in-duct cleaning.

Further, as the cleaning brush body 30 is constructed as above-mentioned, only the tip of each of the plural number of bundles 301 of brush pieces arranged at fixed intervals can touch the surface inside the duct 1. In case that this type of cleaning brush body 30 is used for cleaning the surface inside the duct 1 of any of various inside diameters as shown in FIG. 4, its contact places become limited to such narrow places as, e.g., A,B,C in FIG. 4. Accordingly, said bundles 301 of brush pieces can dustingly sweep and can effectively remove the alien substances accumulating on or adhering to the surface inside the duct 1, via said narrow places, without being slowed down, and with acute-angular and highly impulsive force. Since such cleaning brush body 30 as above-mentioned is used in the present preferred embodiment, its places of contact with the surface inside the duct 1, while doing cleaning, become narrow, and the friction due to the contact becomes small. Accordingly, in this embodiment, dissimilarly to the case of conventional totally contacting type of a brush, it can be avoided that the electric motor to drive the cleaning brush body 30 becomes overloaded and slowed down on account of excessive contact, or that the whole of the traveling truck 11 becomes twisted, inclined, or overturned. In case that said cleaning brush body 30 consisting of plural number of bundles 301 of brush pieces is used, also, its cleaning effect overlaps the cleaning effect obtainable by the different cleaning method of making use of compressed air, thereby yielding a cooperative effect.

If it is desired to make the traveling truck 11 travel in the direction 14 inside the duct 1, clean the surface inside the duct 1 throughout, and turn back at the end of the duct 1 in the reverse direction, it is naturally possible to make the traveling truck 11 turn back in the reverse direction, and make both of the ejection nozzle body 13 and the cleaning brush body 30 clean the surface inside the duct 1 for the second time. However, in this reverse direction case, oppositely to the normal direction case of in-duct cleaning in the direction 14, the compressed air is ejected toward the oblique rear of the traveling truck 11. So that, in this reverse direction case, the in-duct cleaning by using the cleaning brush body 30 is firstly performed, and the place of the face inside the duct 1 once cleaned by the brush body 30, is overlappingly cleaned by the ejection nozzle body 13. In this reverse direction in-duct cleaning case also, the cleaning effect given by the cleaning brush body 30 and that given by the compressed air overlap each other, thereby yielding a cooperative effect.

The in-duct cleaning apparatus of the present invention consists of the aforementioned structure, brings about the aforementioned operational effects, and consequently yields overall effects as follows.

Firstly, in said in-duct cleaning apparatus, the ejection nozzle body for ejecting compressed air is attached to the front part of the traveling truck and made to rotate, the cleaning brush body is attached to the circumferential part of the ejection nozzle body, and two kinds of cleaning operations, (i.e., the cleaning operation by the compressed air ejected from the rotating ejection nozzle body and that by the cleaning brush body) are jointly executed under the remote control of the remote-control portion. As the result of said joint execution of both cleaning operations, not only their respective weak points supplement each other, but a cooperative effect based on both cleaning operations can be obtained. Accordingly, when the present invention is utilized; the cleaning effect of the in-duct cleaning case wherein only a cleaning brush is used or the in-duct cleaning case wherein only an ejection nozzle is used, as seen in the prior art, can be increased double.

Secondly, said in-duct cleaning apparatus, in addition to the above first effect, can make the rotating ejection nozzle body blow the alien substances off and remove them from the surface inside the duct in oblique front of the traveling truck by using the compressed air ejected from its plural number of ejecting holes, and along with that, can make the cleaning brush body overlappingly clean that same place of the surface inside the duct, and thus can execute the in-duct cleaning thoroughly. Said cleaning brush body is constructed such that the plural number of bundles of brush pieces are planted radially and at fixed intervals on the circumferential part of the ejection nozzle body, so that it never occurs that the whole brush surface contacts with the surface inside the duct as in the prior art. As a result, the following troubles as seen in the prior art can be avoided: the electric motor for driving the cleaning brush becomes overloaded (on account of excessive friction between the brush and the surface inside the duct) and slowed down to make the effect of in-duct cleaning yielded by the apparatus lower; or the whole of the traveling truck of the apparatus becomes twisted, inclined, or overturned to make the in-duct cleaning by the apparatus unsuccessful.

What is claimed is:

1. A system and apparatus for cleaning inside surfaces of a duct, comprising:

a traveling means having a longitudinal axis;

a driving means for driving said traveling means forwardly and backwardly in an interior of the duct to be cleaned;

a rotating duct-cleaning means secured to a forwardly extending rotatable shaft, said duct-cleaning means comprising in combination compressed air ejection throughholes that pass therethrough and brush bristles that extend radially therefrom, said rotating duct-cleaning means being supported at a forward end of said rotatable shaft and rotatable about said longitudinal axis, rotatably fixed to said traveling means and directed in a forward travel direction of said traveling means;

an electric motor means for rotating said rotating duct-cleaning means via said rotatable shaft;

an air compressor for supplying compressed air to said compressed-air ejection throughholes;

a control valve for controlling air flow through said rotating duct-cleaning means;

a remote electronic circuit connected to said electric motor, said control valve and said driving means for controlling said driving means, said electric motor means and said control valve, and a remote control means for remotely controlling said remote electronic circuit.

2. A system and apparatus as defined in claim 1, wherein said compressed-air ejection throughholes have their openings directed obliquely forward with respect to the forward traveling direction of said traveling means.

3. A system and apparatus as defined in claim 1, wherein said brush bristles are provided on a circumference of said rotatable duct-cleaning means in the form of a plurality of radially spaced bundles having spatial intervals.

4. A system and apparatus as defined in claim 2, wherein said brush bristles are provided on a circumference of said rotatable duct-cleaning means in the form of a plurality of radially spaced bundles having spatial intervals.

5. A system and apparatus as set forth in claim 2, in which said compressed-air ejection throughholes are fixed between pairs of said brush bristles.

6. A system and apparatus as set forth in claim 3, in which said compressed-air ejection throughholes are fixed between pairs of said brush bristles.

7. A system and apparatus as set forth in claim 4, in which said compressed-air ejection throughholes are fixed between pairs of said brush bristles.

* * * * *